US006681506B2

(12) United States Patent
Altmann et al.

(10) Patent No.: US 6,681,506 B2
(45) Date of Patent: Jan. 27, 2004

(54) PROCESS FOR THE IRONING OF FABRICS, AND REFILL CARTRIDGE FOR IRONS

(75) Inventors: Markus Wilhelm Altmann, Brussels (BE); Arturo Luis Casado Dominguez, Brussels (BE); Bruno Albert Jean Hubesch, Neerijse-Huldenberg (BE); Heidi Simonne Mariette Soyez, Oostende (BE)

(73) Assignee: The Procter & Gamble Company, Cincinnati, OH (US)

( * ) Notice: Subject to any disclaimer, the term of this patent is extended or adjusted under 35 U.S.C. 154(b) by 279 days.

(21) Appl. No.: 10/045,516

(22) Filed: Oct. 26, 2001

(65) Prior Publication Data

US 2003/0045629 A1 Mar. 6, 2003

(51) Int. Cl.[7] ..... D06F 75/18; C02F 5/08
(52) U.S. Cl. ..... 38/77.8
(58) Field of Search ..... 38/77.8, 77.1, 38/77.83, 75, 77.5; 210/282; 423/347; 510/513, 535, 108, 445; 522/3

(56) References Cited

U.S. PATENT DOCUMENTS

| | | | | | |
|---|---|---|---|---|---|
| 3,299,112 | A | | 1/1967 | Bailey | |
| 4,647,598 | A | * | 3/1987 | Yada et al. | 522/3 |
| 5,507,108 | A | * | 4/1996 | Bruggink et al. | 38/77.8 |
| 6,128,839 | A | | 10/2000 | Debourg et al. | |
| 6,328,951 | B1 | * | 12/2001 | White et al. | 424/76.1 |

FOREIGN PATENT DOCUMENTS

| | | | |
|---|---|---|---|
| EP | 0 819 789 | A1 | 1/1998 |
| FR | 2632331 | * | 12/1989 |
| GB | 743 944 | A | 1/1956 |
| JP | 05 059672 | A | 7/1993 |
| JP | 200045176 | * | 2/2000 |
| WO | WO 99/55948 | A1 | 11/1999 |
| WO | WO 00/08247 | A1 | 2/2000 |

* cited by examiner

*Primary Examiner*—Ismael Izaguirre
(74) *Attorney, Agent, or Firm*—Jason J. Camp; Kim W. Zerby; Steven W. Miller

(57) ABSTRACT

The invention relates to a process of ironing fabrics. The iron contains a refill cartridge, which contains a concentrated ironing aid. The concentrated aid is then diluted with water in the iron before it is provided to the fabrics during ironing. The aid comprises a nonionic silicone containing surfactant.

14 Claims, No Drawings

PROCESS FOR THE IRONING OF FABRICS, AND REFILL CARTRIDGE FOR IRONS

CROSS REFERENCE TO RELATED APPLICATIONS

This application claims priority under 35 U.S.C. §119(a) to European Application Serial No. 00870276.3, filed Nov. 20, 2000 and under 35 U.S.C. §371 to PCT Application Serial No. PCT/US00/29769, filed Oct. 27, 2000.

TECHNICAL FIELD

The invention relates to a process of ironing fabrics. The iron contains a refill cartridge, which contains a concentrated ironing aid. The concentrated aid is then diluted with water in the iron before it is provided to the fabrics during ironing. The aid comprises a nonionic silicone containing surfactant.

BACKGROUND

The present invention relates to the ironing of fabrics. It is well-known that ironing of fabrics is conveniently achieved with ironing aids. Ironing aids are products, which assist in the ironing of fabrics, in one way or the other, mainly by enhancing the glide of the soleplate of the iron on the fabrics. It is also known that ironing aids can be provided by means of standalone products, typically sold in aerosols or manual sprayers. It is also known that ironing aids can be provided "through-the-iron", but such executions are much less common, on a commercial scale. And amongst those executions, a preferred one is one where the ironing aid is provided to the iron in the form of a concentrated product, and the concentrated product is diluted with water from a water tank in the iron. The concentrated product would then be provided to the iron by means of cartridge refills. Such an execution has the advantage that a refill will last a long time because it contains a concentrated product, and thus the iron can use a high dilution factor. Such an iron has been disclosed in WO99/27176, now U.S. Pat. No. 6,128,839, issued Oct. 10, 2000 to Debourg, et al.

However, such executions have to our knowledge never been commercialized. A particular problem which is encountered in these executions is that an ironing aid must be formulated which contains a high level of active, which mixes easily with water, and which is stable both in concentrated and diluted form, and across a variety of temperatures ranging from ambient during storage, to warm during use, due to the proximity of the soleplate.

The invention solves this problem by proposing the use of nonionic silicone containing surfactants. Concentrated compositions of such surfactants indeed meet the aforementioned objects.

SUMMARY OF THE INVENTION

In a first embodiment, the present invention encompasses a process of ironing fabrics with an iron and an ironing aid product. The ironing aid product is provided to the iron as a concentrated product. The concentrated product is diluted with water in the iron and then provided from the iron to the fabrics. The product comprises from 5% to 40% of a nonionic silicone containing surfactant, from 60% to 95% water, and has a viscosity of from 1 cps to 40 cps at 100 rpm at 20° C.

In a second embodiment, the present invention encompasses an article of manufacture suitable for use in the process. The article of manufacture comprises a container and content inside the container, and usage instructions. The content is the ironing aid product. The usage instructions instruct that the ironing aid product must be provided to an iron in which the ironing aid product will be diluted with water. The usage instructions may be printed on the container or provided separately. There may be a single container with its content, or several containers with their content provided with one set of instructions. Preferably, the container and its content are a refill cartridge for an iron.

In a third embodiment, the invention encompasses a kit of parts which comprises an iron, and an article of manufacture comprising a container, the ironing aid product as its content, and usage instructions.

DETAILED DESCRIPTION OF THE INVENTION

The process according to the invention requires an iron and an ironing aid product.

The iron to be used in the process according to the invention is one which is able to receive and contain water in a water tank, which is able to receive a concentrated composition, which is able to dilute the concentrated composition with the water, and which is able to deliver the diluted composition to the fabrics during the process of ironing fabrics. Such an iron has been disclosed in WO99/27176, now U.S. Pat. No. 6,128,839 cited above, which is incorporated herein by reference.

The product to be used in the present invention is a concentrated composition of a nonionic silicone containing surfactant. Suitable such surfactants for use herein are comprised in the class of surfactants according to the formula:

$$\begin{array}{l} R1\text{—}(CH_3)_2SiO\text{—}[(CH_3)_2SiO]_a\text{—}[(CH_3)(R1)SiO]_b\text{—}Si(CH_3)_2\text{—} \\ \quad R1 \end{array}$$

wherein a+b is from about 1 to about 50, preferably from about 1 to about 30, more preferably from about 1 to about 25, and each R1 is the same or different and is selected from the group consisting of methyl and a poly(ethylene oxide/propylene oxide) copolymer group having the general formula:

$$\text{—}(CH_2)_n\text{—}O(C_2H_4O)_c\text{—}(C_3H_6O)_d\text{—}R2$$

with at least one R1 being a poly(ethyleneoxy/propyleneoxy) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 7 to about 100 and each R2 is the same or different and is selected from the group consisting of hydrogen, an alkyl having 1 to 4 carbon atoms, and an acetyl group, preferably hydrogen and methyl group. Each polyalkylene oxide polysiloxane has at least one R1 group being a poly(ethylene oxide/propylene oxide) copolymer group.

Non-limiting examples of this type of surfactants are the Silwet® surfactants which are available OSI Specialties Inc., a Division of Witco, Danbury, Conn. Representative Silwet® surfactants which contain only ethyleneoxy ($C_2H_4O$) groups are as follows.

| Name | Average MW | Average a + b | Average total c |
|---|---|---|---|
| L-7608 | 600 | 1 | 8 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |
| L-7622 | 10,000 | 88 | 75 |

Non-limiting examples of Silwet® surfactants which contain both ethyleneoxy (EO) ($C_2H_4O$) and propyleneoxy (PO) ($C_3H_6O$) groups are as follows:

| Name | Average MW | EO/PO ratio |
|---|---|---|
| L-7200 | 12,000 | 50/50 |
| L-7001 | 20,000 | 40/60 |
| L-7002 | 8,000 | 50/50 |
| L-7210 | 13,000 | 20/80 |
| L-7200 | 19,000 | 75/25 |
| L-7220 | 17,000 | 20/80 |

The molecular weight of the polyalkyleneoxy group (R1) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units (—$C_2H_4O$) in the polyether chain (R1 ) must be sufficient to render the polyalkylene oxide polysiloxane water-soluble. If propyleneoxy groups are present in the polyalkylenoxy chain, they can be distributed randomly in the chain or exist as blocks. Mixtures of Silwet® surfactants which contain both ethyleneoxy and propyleneoxy groups, are also preferred. Preferred Silwet® surfactants are the L-7001, L-7087, L-7200, L-7280, L-7600, L-7608, L-7622, L-7657.

The preparation of polyalkylene oxide polysiloxanes is well-known in the art. Polyalkylene oxide polysiloxanes of the present invention can be prepared according to the procedure set forth in U.S. Pat. No. 3,299,112, incorporated herein by reference. Typically, polyalkylene oxide polysiloxanes of the surfactant blend of the present invention are readily prepared by a hydrosilation reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well-known in the art and in general involve heating the reactants (e.g., at a temperature of from about 85° C. to 110° C.) in the presence of a platinum catalyst (e.g., chloroplatinic acid) and a solvent (e.g., toluene).

Products herein may be formulated with a single surfactant from that class, or mixtures thereof. The suitable surfactants within that class, or mixtures thereof, will have—at the selected concentration—a viscosity of from 1 cps and 40 cps at 100 rpm at 20° C. (measured with a Brookfield® LBV 01 viscometer, with spindle No 1), preferably between 3 cps and 15 cps, most preferably between 5 cps and 10 cps. Such a low viscosity will enable a good miscibility of the product in water, which is a key requirement in the present circumstances, where the product is mixed with water in the iron, usually shortly before it is provided to the fabrics.

The product herein comprises from 5% to 40% by weight of the total product of said surfactants, preferably from 8% to 25%, and most preferably from 10% to 20%. The products herein are aqueous solutions of such surfactants, and so they comprise from 60% to 95% by weight of the total product of water, preferably from 75% to 92%, most preferably from 80% to 90%.

The products herein are phase stable. A suitable test protocol for measuring phase stability is described hereinafter in the examples. In order to ensure phase stability at higher temperatures, however, it may be necessary to formulate an emulsifier in the product. Suitable emulsifiers for use herein include sodium and potassium salts of straight-chain fatty acids; sodium and potassium salts of coconut oil fatty acids; sodium and potassium salts of tall oil acids; linear alkylbenzenesulfonates; benzene-, toluene-, xylene-, cumenesulfonates; ligninsulfonates; petroleum sulfonates; paraffin sulfonates, secondary n-alkanesulfonates; alfa-olefin sulfonates; sulfosuccinate esters; alkylnaphthalene-sulfonates; isethionates; sulfated linear primery alcohols; sulfonates polyoxyethylenated straight-chain alcohols; sulfated triglyceride; phosphoric and polyphosphoric acid esters; perfluorinated anionics; long-chain amines and their salts; diamines and polyamines and their salts; quaternary ammonium salts; polyoxyethylenated long-chain amines; quaternarized polyoxyethylenated long-chain amines; amine-oxides; polyoxyethylenated alkylphenols, polyoxyethylenated straight-chain alcohol; polyoxyethylenated polyoxypropylene glycols; polyoxyethylenated mercaptans; long-chain carboxylic acid esters; glyceryl and polyclyceryl esters of natural fatty acids; propylene glycol, sorbitol, and polyoxyethylenated sorbitol esters; polyethylene glycol esters and polyoxyethylenated fatty acids; 1:1 and 2:1 alkanolamine-fatty acid condensates; tertiary acetylenic glycols; N-alkylpyrrolidones; alkylpolyglycosides; beta-N-alkylaminopropionic acids; N-alkyl-beta-iminodipropionic acids; imidazoline carboxylates; N-alkylbetaines; sulfobetaines. Preferred emulsifiers are Sodium dodecabenzene sulfonate, Sodium Laurylsulfate, and C12–14 fatty alcohol ethoxylated with 10–15 ethylene oxide units. The product can comprise from 0.01% to 2% of the emulsifier, preferably from 0.1% to 1%.

Optional minor ingredients, such as preservatives, fragrances, disinfecting components, chelants, solvents, builders, stabilisers, brighteners, dye transfer inhibitors, moisturizers, antioxidants, pH buffers, dyes and the like, constitute the remainder of the product.

In the process embodiment of the invention, the ironing aid product is first provided to the iron. The product is then diluted with water in the iron, and the diluted product is provided to the fabrics by the iron.

The product is suitably provided to the user as an article of manufacture. The article of manufacture comprises a container, which contains the ironing aid product, and usage instructions instructing the user to use the product according to the process. The container can either be a conventional container to be emptied in a reservoir for the product in the iron. But in a preferred execution, the iron contains a receptacle or inlet for a refill cartridge, and the container then is a refill cartridge, which fits in the receptacle or inlet. When emptied, the cartridge is disposed of and replaced.

The usage instructions can be provided in a variety of ways. They can be printed on a surface of the container, or they can be provided by means of a separate leaflet. If the container is packaged in a secondary package, the instructions can be printed on a surface of the secondary package. In a particularly convenient execution, several containers are packaged together in a single secondary package, and the usage instructions are preferably provided by means of a separate leaflet or printed matter.

Furthermore, the usage instructions may be so detailed as to explain that the product is to be diluted in the iron, or they may be shortened so as to merely instruct the user to provide the product to a suitable iron, and specify which iron is suitable (this iron being able to receive and contain water in a water tank, being able to receive the product, being able to dilute the product with the water, and being able to deliver the diluted composition to the fabrics during the process of ironing fabrics.

Finally, the means to practice the invention are advantageously provided by means of a "starter kit", i.e., a kit of parts comprising an iron as described above, and an article of manufacture as described above.

EXAMPLES

The invention is illustrated by, but by no means limited to, the following examples.

Example 1

Dilutability with Water

The following compositions are made by mixing the listed ingredients in the listed proportions. Examples B, C and D are not compositions according to the invention.

| | Compositions | | | |
|---|---|---|---|---|
| | A | B | C | D |
| Silwet ® L7200 | 15% | 80% | — | — |
| Rhodosil huile 21645 | — | — | 15% | |
| Dow corning 200 fluid (350 cs) | — | — | | 15% |
| Silwet ® L7600 | 3% | 17% | 3% | 3% |
| Proxel GXL | 0.15% | 0.15% | 0.15% | 0.15% |
| Perfume | 0.4% | 0.4% | 0.4% | 0.4% |
| Sodium dodecabenzene sulfonate | 0.2% | — | 0.2% | 0.2% |
| Water | balance | balance | balance | balance |
| Viscosity (cps) | 8.0 | 3000 | N.A. | N.A. |

The dilutability with water of the compositions has been assessed, using the following protocol:

3.0 g of the above compositions were poured in standard glass vials (22 mm diameter) with 12.0 g de-mineralized water and a 1 cm long 4-mm diameter teflon coated magnetic bar. The vials were then capped and stirred at 100 rpm for 5 seconds. Samples were then visually inspected for homogenization.

Results on the phase stability of compositions A to D after dilution are given in the following table:

| Composition | Number of phases visually detected |
|---|---|
| A | 1 |
| B | 2 |
| C | 2 |
| D | 2 |

As evidenced, the dilutability of composition A is better than in the case of compositions B to D.

Example 2

Phase Stability at High Temperatures

The following compositions were made by mixing the listed ingredients in the listed proportions.

| | Compositions | |
|---|---|---|
| | A | E |
| Silwet ® L7200 | 15% | 15% |
| Silwet ® L7600 | 3% | 3% |
| Proxel GXL | 0.15% | 0.15% |
| Perfume | 0.4% | 0.4% |
| Sodium dodecabenzene sulfonate | 0.2% | — |
| Water | balance | Balance |
| Viscosity (cps) | 8.0 | 8.0 |

Silwet L7200, polyalkylene oxide-modified silicone from Crompton (99% active).
Silwet L7600, polyalkylene oxide-modified silicone from Crompton (99% active).
Proxel GXL, BIT preservative from Avencia (21% active).

The phase stability of compositions upon storage at high temperatures, such as the ones encountered while ironing, has been assessed through the following 3-steps protocol:

1. Non-volatile content (NVC) analysis of the fresh homogenized composition was determined using a Mettler Toledo HR73 Halogen Moisture Analyzer evaporating at 105° C. until constant residue weight.
2. Storage: 15.0 g of fresh compositions were introduced in standard glass vials (22 mm diameter), hermetically capped. Samples were then stored in ovens at the tested temperature for 3 days.
3. Non-volatile content (NVC) analysis of the composition after storage: The one-gram top liquid layer of the samples contained in the abovementioned vials was pipetted out and analyzed for non-volatiles content (NVC) using the protocol in Step 1. An identical result as in Step 1 would indicate that the composition is stable.

Results on the phase stability of compositions A and E are given in the following table:

| Composition | NVC before storage | Storage Temp. (° C.) | NVC after storage | Reduction in NVC (%) | Number of phases visually detected |
|---|---|---|---|---|---|
| E | 18.3% | 70 | 17.9% | 0% | 1 |
| E | 18.3% | 78 | 6.7% | 64% | 2 |
| A | 18.5% | 78 | 18.5% | 0% | 1 |

Compositions C and B are both stable at 70° C. Composition B is more stable than composition C at 78° C., thanks to the presence of the emulsifier.

What is claimed is:

1. A process of ironing fabrics with an iron and an ironing aid product, comprising the steps of:

providing an ironing aid product to the iron as a concentrated product;

diluting the concentrated product with water in the iron; and providing the diluted product from the iron to the fabrics; characterized in that the concentrated product comprises from 5% to 40% of a nonionic silicone containing surfactant, from 60% to 95% water, the concentrated product having a viscosity of from 1 cps to 40 cps at 100 rpm at 20° C.

2. A process according to claim 1, wherein said nonionic silicone containing surfactant is according to the formula:

$$R1—(CH_3)_2SiO—[(CH_3)_2SiO]_a—[(CH_3)(R1)SiO]_b—Si(CH_3)_2—R1$$

wherein a+b is from about 1 to about 50, and each R1 is the same or different and is selected from the group consisting of methyl and a poly(ethylene oxide/propylene oxide) copolymer group having the general formula:

$$—(CH_2)_n—O(C_2H_4O)_c—(C_3H_6O)_d—R2$$

with at least one R1 being a poly(ethyleneoxy/propyleneoxy) copolymer group, and wherein n is 3 or 4; total c (for all polyalkyleneoxy side groups) has a value of from 1 to about 100; total d is from 0 to about 14; total c+d has a value of from about 5 to about 150, and each R2 is the same or different and is selected from the group consisting of hydrogen, an alkyl having 1 to 4 carbon atoms, and an acetyl group; and each polyalkylene oxide polysiloxane has at least one R1 group being a poly(ethylene oxide/propylene oxide) copolymer group.

3. A process according to claim 1, wherein the ironing aid product further comprises an emulsifier.

4. An article of manufacture suitable for use in a process of ironing fabrics, the article comprising a container;

a content inside said container, said content comprising an ironing aid product that comprises from 5% to 40% of a nonionic silicone containing surfactant, from 60% to 95% water, and that has a viscosity of from 1 cps to 40 cps at 100 rpm at 20° C.; and usage instructions, the usage instructions comprising an instruction that the ironing aid product be provided to an iron in which the ironing aid product will be diluted with water.

5. An article according to claim 4, wherein the usage instructions are provided by means of a leaflet or printed matter which is separate from the container.

6. An article according to claim 4, further comprising one or more additional containers with their content.

7. An article according to claim 4, wherein the container and its content are a refill cartridge for an iron.

8. An article according to claim 4, wherein said nonionic silicone containing surfactant is according to the formula:

$$\begin{array}{l} R1—(CH_3)_2SiO—[(CH_3)_2SiO]_a—[(CH_3)(R1)SiO]_b—Si(CH_3)_2— \\ \quad R1 \end{array}$$

wherein a+b is from about 1 to about 50, and each R1 is the same or different and is selected from the group consisting of methyl and a poly(ethylene oxide/propylene oxide) copolymer group having the general formula:

$$—(CH_2)_n—O(C_2H_4O)_c—(C_3H_6O)_d—R2$$

with at least one R1 being a poly(ethyleneoxy/propyleneoxy) copolymer group, and wherein n is 3 or 4; total c (for all polyalkyleneoxy side groups) has a value of from 1 to about 100; total d is from 0 to about 14; total c+d has a value of from about 5 to about 150, and each R2 is the same or different and is selected from the group consisting of hydrogen, an alkyl having 1 to 4 carbon atoms, and an acetyl group; and each polyalkylene oxide polysiloxane has at least one R1 group being a poly(ethylene oxide/propylene oxide) copolymer group.

9. An article according to claim 4, wherein the ironing aid product further comprises an emulsifier.

10. A kit for ironing fabrics, the kit comprising an iron in which a product can be diluted with water; and an article of manufacture having a container;

a content inside said container, said content comprising an ironing aid product that comprises from 5% to 40% of a nonionic silicone containing surfactant, from 60% to 95% water, and that has a viscosity of from 1 cps to 40 cps at 100 rpm at 20° C.; and usage instructions, the usage instructions comprising an instruction that the ironing aid product be provided to an iron in which the ironing aid product will be diluted with water.

11. A kit according to claim 10, wherein the usage instructions are provided by means of a leaflet or printed matter which is separate from the container.

12. A kit according to claim 10, wherein the container and its content are a refill cartridge for the iron.

13. A kit according to claim 10, wherein said nonionic silicone containing surfactant is according to the formula:

$$\begin{array}{l} R1—(CH_3)_2SiO—[(CH_3)_2SiO]_a—[(CH_3)(R1)SiO]_b—Si(CH_3)_2— \\ \quad R1 \end{array}$$

wherein a+b is from about 1 to about 50, and each R1 is the same or different and is selected from the group consisting of methyl and a poly(ethylene oxide/propylene oxide) copolymer group having the general formula:

$$—(CH_2)_n—O(C_2H_4O)_c—(C_3H_6O)_d—R2$$

with at least one R1 being a poly(ethyleneoxy/propyleneoxy) copolymer group, and wherein n is 3 or 4; total c (for all polyalkyleneoxy side groups) has a value of from 1 to about 100; total d is from 0 to about 14; total c+d has a value of from about 5 to about 150, and each R2 is the same or different and is selected from the group consisting of hydrogen, an alkyl having 1 to 4 carbon atoms, and an acetyl group; and each polyalkylene oxide polysiloxane has at least one R1 group being a poly(ethylene oxide/propylene oxide) copolymer group.

14. A kit according to claim 10, wherein the ironing aid product further comprises an emulsifier.

* * * * *